US006905553B2

(12) United States Patent
Rodeback et al.

(10) Patent No.: US 6,905,553 B2
(45) Date of Patent: Jun. 14, 2005

(54) DEVICE FOR REMOVING RESIDUES FROM SURFACES AND A METHOD FOR ACCOMPLISHING THE SAME

(75) Inventors: Shawn T. Rodeback, Smithfield, UT (US); Edward E. Durrant, Providence, UT (US)

(73) Assignee: Harris Research, Inc., Logan, UT (US)

( * ) Notice: Subject to any disclaimer, the term of this patent is extended or adjusted under 35 U.S.C. 154(b) by 0 days.

(21) Appl. No.: 10/805,905

(22) Filed: Mar. 22, 2004

(65) Prior Publication Data

US 2004/0182420 A1 Sep. 23, 2004

Related U.S. Application Data

(60) Provisional application No. 60/456,273, filed on Mar. 20, 2003.

(51) Int. Cl.[7] ..... B08B 7/04

(52) U.S. Cl. ..... 134/6; 134/11; 134/26; 134/31; 134/34; 134/36; 134/37; 134/42; 401/136; 15/104.93; 15/104.94; 15/320; 15/321; 15/322

(58) Field of Search ..... 15/104.93, 104.94, 15/320, 321, 322; 401/136; 134/6, 11, 26, 31, 34, 36, 37, 42

(56) References Cited

U.S. PATENT DOCUMENTS

| | | | | | |
|---|---|---|---|---|---|
| 2,987,906 | A | * | 6/1961 | Bourland | 68/213 |
| 3,041,644 | A | * | 7/1962 | Wallace | 15/50.3 |
| 3,698,030 | A | * | 10/1972 | Lockett | 15/104.94 |
| 3,883,301 | A | * | 5/1975 | Emrick et al. | 8/158 |
| 4,351,081 | A | * | 9/1982 | Tarkinson | 15/210.1 |
| 4,353,145 | A | * | 10/1982 | Woodford | 15/321 |
| 4,395,347 | A | | 7/1983 | McLaughlin et al. | 252/139 |
| 4,543,206 | A | | 9/1985 | Adams | 252/557 |
| 4,804,486 | A | | 2/1989 | Day | 252/153 |
| 5,002,684 | A | * | 3/1991 | Beck et al. | 8/102 |
| 5,007,038 | A | | 4/1991 | Nakane et al. | 369/44.11 |
| 5,024,779 | A | | 6/1991 | Helioff et al. | 252/162 |
| 5,372,742 | A | | 12/1994 | Bayless | 252/170 |
| 5,615,449 | A | * | 4/1997 | Sepke | 15/322 |
| 5,691,289 | A | | 11/1997 | Purcell et al. | 510/174 |
| 5,827,807 | A | | 10/1998 | Aoshima et al. | 510/118 |
| 5,867,860 | A | * | 2/1999 | Harris | 15/320 |
| 5,876,461 | A | * | 3/1999 | Racette et al. | 8/137 |
| 6,030,464 | A | | 2/2000 | Azevedo | 134/6 |
| 6,071,865 | A | | 6/2000 | Pickering et al. | 510/118 |
| 6,185,781 | B1 | * | 2/2001 | Miller et al. | 15/322 |
| 6,225,269 | B1 | | 5/2001 | Baker | 510/118 |
| 6,260,232 | B1 | * | 7/2001 | Nelson et al. | 15/322 |
| 6,405,735 | B1 | | 6/2002 | Dockery | 132/72.5 |

* cited by examiner

*Primary Examiner*—Sharidan Carrillo
(74) *Attorney, Agent, or Firm*—Starkweather and Associates; Michael W. Starkweather; Jason P. Webb

(57) ABSTRACT

The present invention involves a solvent vapor transfer device for holding an absorbent pad, which receives and disperses solvent vapors over a lacquer-based residue on a textile. A solvent is poured or dripped into an absorbent pad portion of the vapor transfer box, from which solvent vapors are released. The solvent vapors pass through the vapor transfer box and concentrate in a vapor chamber over the lacquer-based residue and textile. As the solvent vapors come into continuous contact with the lacquer-based residue, the residue begins to dissolve and soften. Upon sufficient dissolution, minute quantities of the liquid solvent may be applied directly to the partially dissolved residue and quickly suctioned into an extraction vacuum. This process may be repeated as necessary to achieve complete removal of the residue.

18 Claims, 4 Drawing Sheets

DEVICE FOR REMOVING RESIDUES FROM SURFACES AND A METHOD FOR ACCOMPLISHING THE SAME

CROSS-REFERENCES TO RELATED APPLICATIONS

This application claims priority to U.S. Provisional Patent Application No. 60/456,273 entitled "A Method of Removing Lacquer From Textiles" and filed on Mar. 20, 2003 for Shawn T. Rodeback and Edward E. Durrant, which is incorporated herein by reference.

BACKGROUND OF THE INVENTION

1. The Field of the Invention

The invention relates to a device for removing lacquer-based polishes, such as fingernail polish, from textiles, such as carpet, and a method of doing the same. Specifically, the present illustrated embodiment(s) involve(s) the use of a vapor transfer device to direct solvent vapors over a lacquer based residue on a textile.

2. The Relevant Art

Lacquer based polishes and/or paints ("residues") have historically been a bane to the existence of carpet owners. This is primarily due to the fact that these polishes and/or paints, such as fingernail polish, contain resins that form hard residues when allowed to dry. When left to dry on a textile, such as carpet, the extraction of these resins can be extremely difficult and potentially damaging to the textile itself.

Under the typical and well-known polish extraction techniques, a variety of solvents may be poured over the affected area in order to dissolve and soften the residue. A commonly recognized aspect of this process is to ensure that the solvent remains in continuous contact with the residue in order to fully dissolve the same. However, prolonged contact of the solvent with the textile may cause a latex adhesive or similar fabric backing to delaminate. This is a common problem resulting from applying such solvents to carpets because typical latex adhesives that bind carpet fibers to the carpet backing material can be degraded relatively quickly by overexposure to the solvent.

Many of the solvents suitable for dissolving lacquer-based compounds are volatile. These solvents tend to evaporate before they have had sufficient contact time with the affected area and the dissolution process fails. Furthermore, many of these volatile solvents are flammable, which makes suction of the solvent into non-spark proof wet vacuums dangerous. As a result, methods utilizing volatile solvents typically involve blotting or rubbing the treated area, which are much less effective and much more labor intensive than suction techniques.

Thus, it can be clearly recognized that there is a need for a device for removing lacquer-based residues from textiles, such as carpet, that does not damage the affected textile, and a method for accomplishing the same.

SUMMARY OF THE INVENTION

The various elements of the present invention have been developed in response to the present state of the art, and in particular, in response to the problems and needs in the art that have not yet been fully solved by currently available devices and methods for removing lacquer-based paints from textiles, such as carpet. Accordingly, the present invention relates generally to a device for removing lacquer-based paints and/or polishes, such as fingernail polish, from textiles, such as carpet and a method of accomplishing the same. More specifically, the present illustrated embodiment(s) involve(s) the use of a solvent, an absorbent pad, and a vapor transfer box for directing solvent vapors over a residue on a textile.

More particularly, the present invention involves a solvent vapor transfer device for holding an absorbent pad, which receives and disperses solvent vapors over a lacquer-based residue on a textile. A solvent may be poured or dripped into the absorbent pad portion of the vapor transfer box, from which solvent vapors are released. The solvent vapors pass through the vapor transfer box and concentrate in a vapor chamber over the lacquer-based residue and textile. As the solvent vapors come into continuous contact with the lacquer-based residue, the residue begins to dissolve and soften. Upon sufficient dissolution, minute quantities of the liquid solvent may be applied directly to the partially dissolved residue and quickly suctioned into an extraction vacuum. This process may be repeated as necessary to achieve complete removal of the residue.

Additional features and advantages of the present invention will become more fully apparent from the following description and appended claims, or may be learned by the practice of the invention as set forth hereinafter.

BRIEF DESCRIPTION OF THE DRAWINGS

In order for the advantages of the invention to be readily understood, a more particular description of the invention briefly described above will be rendered by reference to specific embodiments thereof, which are illustrated in the appended drawing. Understanding that this drawing depicts only one typical embodiment of the invention and is not therefore to be considered to be limiting of its scope, the invention will be described and explained with additional specificity and detail through the use of the accompanying drawing in which.

DETAILED DESCRIPTION OF THE INVENTION

Reference throughout this specification to "one embodiment," "an embodiment," or similar language means that a particular feature, structure, or characteristic described in connection with the embodiment is included in at least one embodiment of the present invention. Thus, appearances of the phrases "in one embodiment," "in an embodiment," and similar language throughout this specification may, but do not necessarily, all refer to the same embodiment.

Furthermore, the described features, structures, or characteristics of the invention may be combined in any suitable manner in one or more embodiments. One skilled in the relevant art will recognize, however, that the invention can be practiced without one or more of the specific details, or with other methods, components, materials, and so forth. In other instances, well-known structures, materials, or operations are not shown or described in detail to avoid obscuring aspects of the invention.

Figure 1:
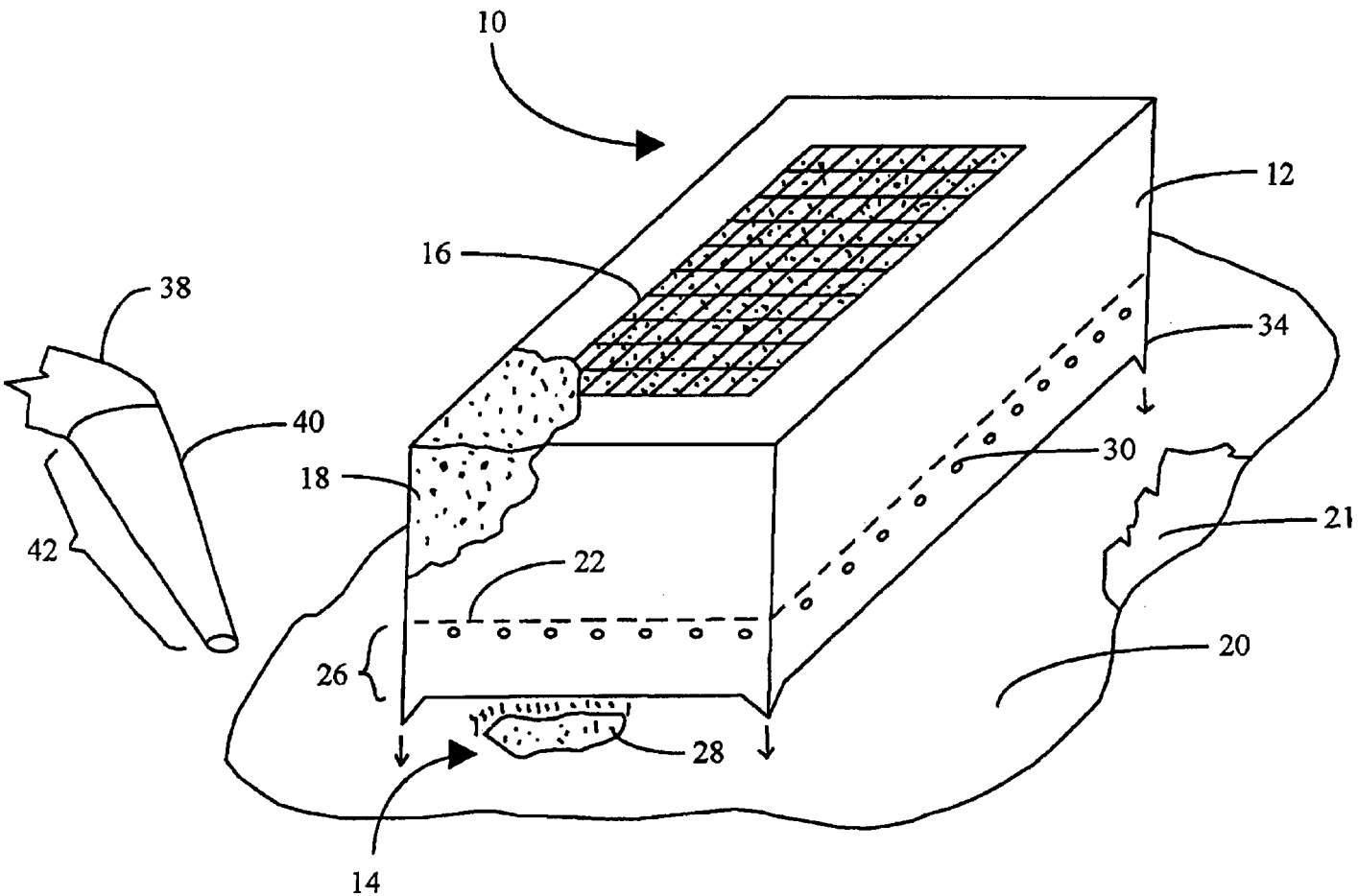
FIG. 1 illustrates a perspective view of one embodiment of the present invention.
Figure 2:
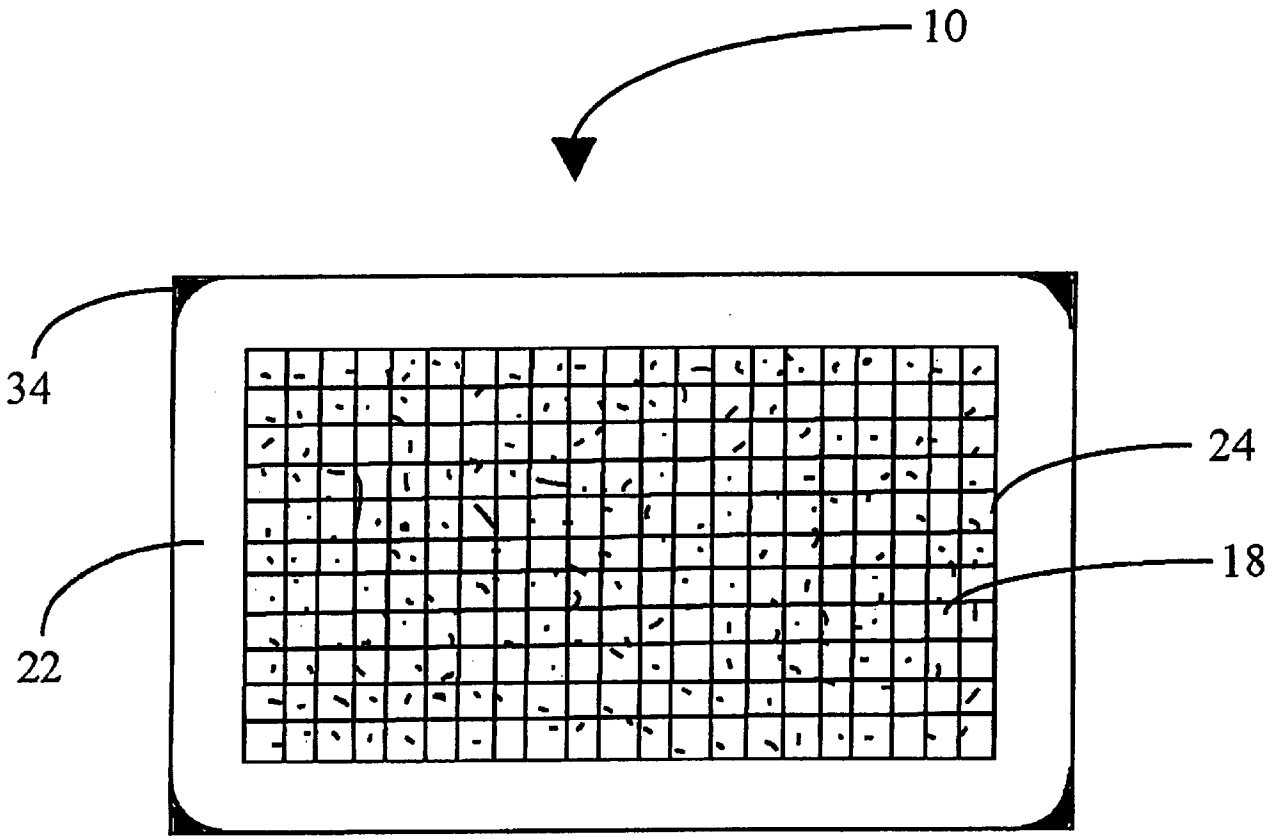
FIG. 2 illustrates a bottom view one an embodiment of the vapor transfer box of FIG. 1.

FIGS. 1 and 2 illustrate an embodiment of a vapor transfer box 10. The vapor transfer box 10 sets borders around the working area of a vapor transfer 14. The vapor transfer box 10 includes a screen 16 located on its top side through which a solvent may be administered to an absorbent pad 18 located there below. A commonly utilized solvent may be ethyl-acetate, although any known solvent may be employed, including, but not limited to, N-methyl pyrrolidinone, acetone, diethylene glycol monobutyl ether, dimethyl adipate, dimethyl glutarate, dimethyl succinate, dipropylene glycol monomethyl ether, 1-ethyl-2-pyrrolidinone, ethylene glycol butyl ether, d-limonene, methyl isobutyl carbinol, propylene glycol butyl ether, propylene glycol methyl ether, propylene glycol n-propyl ether, and ethylene glycol t-butyl ether. The absorbent pad 18 receives and holds the solvent to prevent it from passing directly through the vapor transfer box 10 and immediately being applied onto a textile surface 20. The absorbent pad 18 rests atop a pad retention lip, or support member 22, which attaches to an interior portion of the vapor transfer box 10. The pad retention lip 22 supports a lower liquid solvent screen 24 through which vapors of the solvent may pass.

In this embodiment, a vapor transfer chamber 26, located at the base of the vapor transfer box 10, is situated below the lower liquid solvent screen 24, and above the textile surface 20. Heavy solvent vapors diffuse from the absorbent pad 18 through the lower liquid solvent screen 24 and concentrate in the vapor transfer chamber 26, thus contacting a residue 28 that is to be removed. Diffusion holes 30, situated along an upper portion of the vapor transfer chamber 26, allow ambient air within the vapor transfer chamber 26 to escape, thus allowing the typically heavier solvent vapors to fill and completely occupy the vapor transfer chamber 26 for maximum concentration around the textile surface 20 and residue 28.

In another embodiment, the vapor transfer box 10 includes box stabilizers 34, which are designed to set firmly within fibers of a textile surface 20, over the residue 28.

Figure 3:
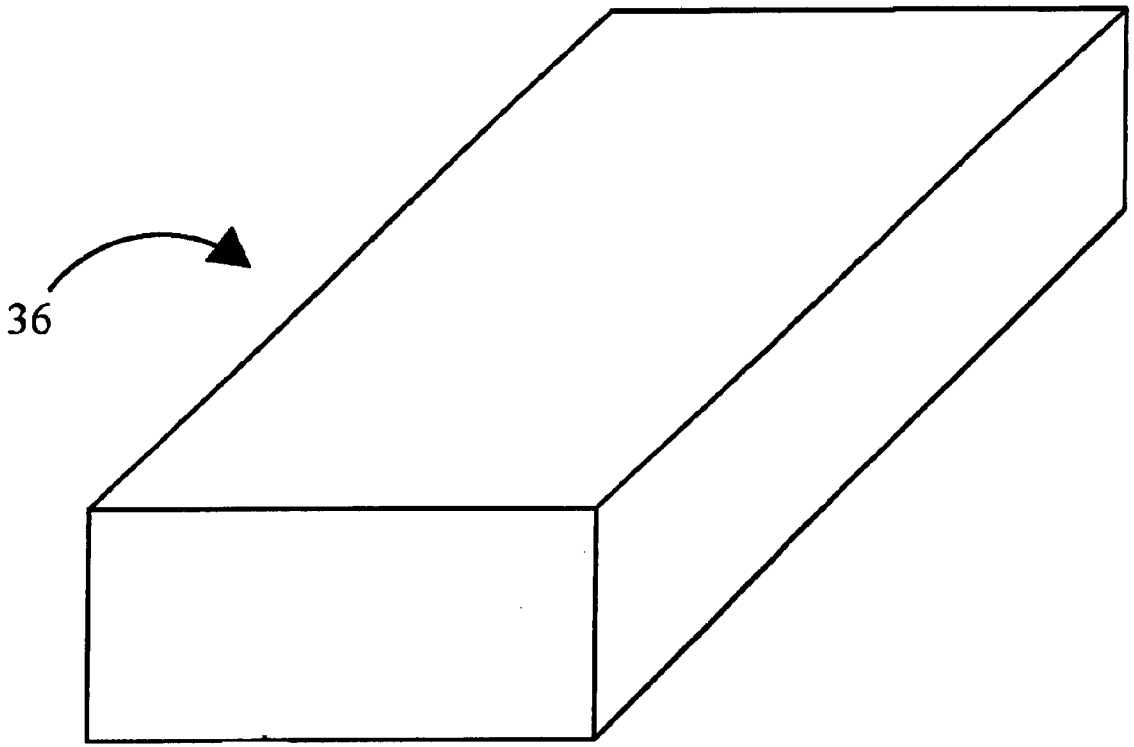
FIG. 3 illustrates a perspective view of an embodiment of the optional lid for the invention of FIG. 1.

FIG. 3 shows one embodiment of an optional vapor lid 36 which may be placed over the vapor transfer box 10. The vapor lid 36 is for placement atop the screen 16 after a sufficient quantity of solvent has been administered to the absorbent pad 18. The vapor lid 36 serves to maximize the concentration of vapors flowing down on to the textile surface 20 (not being lost to diffusion through the upper liquid solvent screen 16) and to minimize the ambient smell of the solvent.

Figure 4:
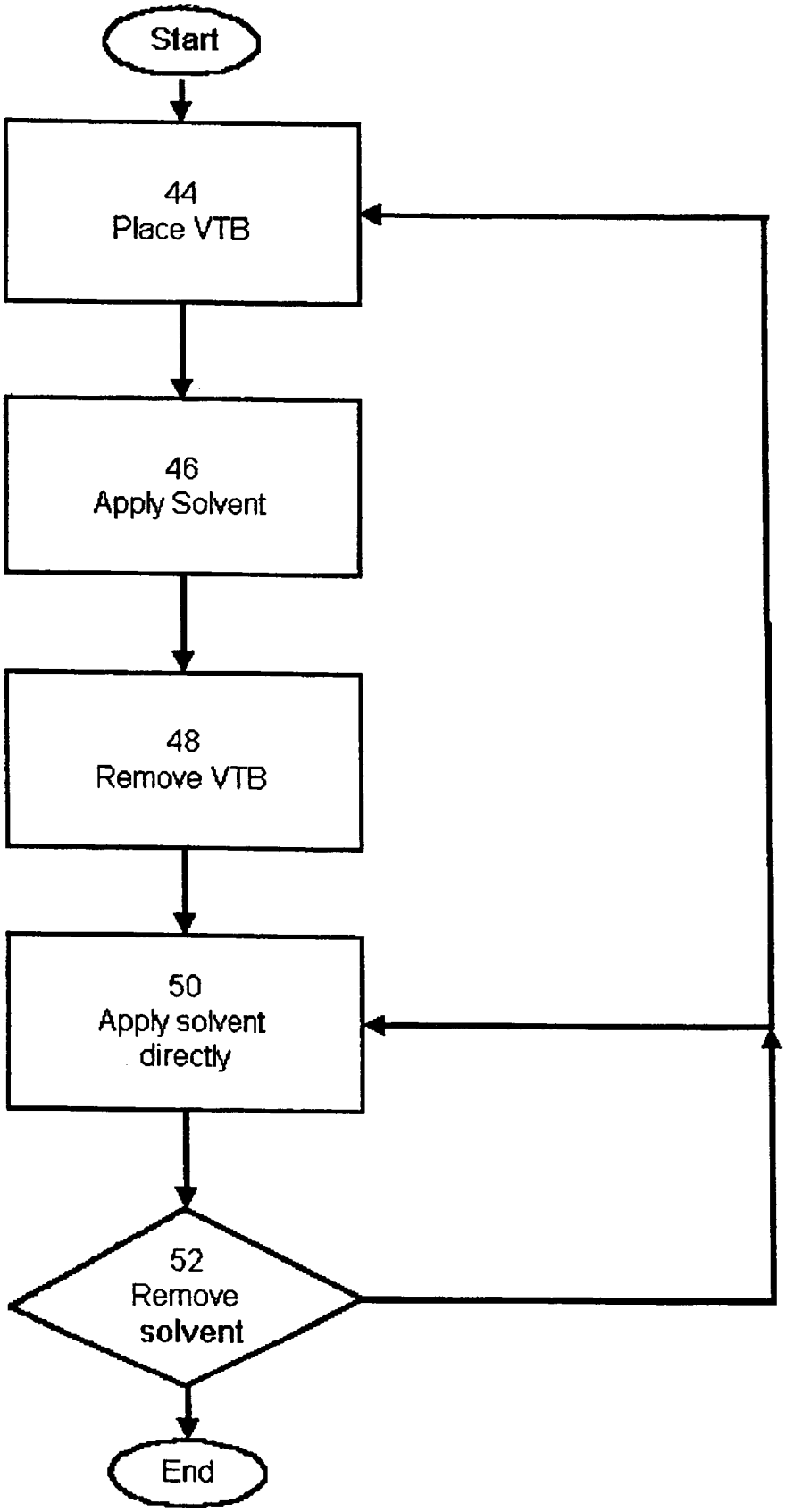
FIG. 4 illustrates a flow chart according to one embodiment of the present invention.

The general procedure for removing residues 29 from textiles with the vapor transfer box 10 is described in FIG. 4 and includes several steps. The vapor transfer box 10 is configured to receive and retain a solvent for the purpose of transferring the solvent's vapors down to a textile 20 lying within a border of the vapor transfer box 10. In one embodiment, the vapor transfer box 10 may be positioned 44 over the textile 20 patch with the residue 28 before the solvent is added to the absorbent pad 26. In another embodiment, the vapor transfer box 10 may be positioned over the textile 20 patch with the residue 28 after the solvent has been added to the absorbent pad 26. It is recognized, however, that it would be beneficial to apply the solvent to the absorbent pad 26 before positioning the vapor transfer box 10 over the lacquer-based residue 28 to eliminate any risks from over-saturating the absorbent pad 26.

The solvent may be dripped or poured 46 onto the absorbent pad 18 within the vapor transfer box 10. It should be noted that it is desirable for the absorbent pad 18 to receive enough solvent to facilitate the transfer of vapor through the absorbent pad 20 to the textile 20, but not so much as to saturate the absorbent pad 18 to the point of dripping solvent onto the textile 20. Too much solvent in the absorbent pad 26 may defeat the purpose of the vapor transfer box 10 because the excess solvent may drip from the pad directly onto the textile 20 and dissolve the bind material 21.

In the next application step, it is preferable that the vapor transfer box 10 remain situated over lacquer-based residue 28 sufficiently long to soften the residue 28. Exposure time for the residue 20 to the solvent will vary depending on the type of residue 28 and the size of the residue 28 patch.

In a subsequent step, after the residue 28 has been exposed to the solvent for a sufficient time, the vapor transfer box 10 is removed 48. To improve the dissolution of the residue 20, small quantities of solvent may be applied 50 directly to the residue 28. The amount of solvent depends on the type and size of the residue 28. However, it is noted, it is preferable to avoid solvent contact with the textile 20 binding material 21.

In a following step, before the solvent dissipates, it is often necessary to repeatedly apply solvent directly to the textile and immediately suction off 52 the solvent with a wet vacuum 38 or other suction device commonly used in the industry. In one embodiment, a specially designed suction tip 40 may be used to enhance the speed of solvent removal. The tip 40 uniquely has a tapering tip 42.

It may be necessary to repeat the entire process until the residue 28 has been completely dissolved and removed from the surface of the textile 20.

It is understood that the above-described arrangements are only illustrative of the application of the principles of the presently illustrated invention. The present invention may, however, be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

For example, although the illustrative embodiment(s) have/has described the use of a box-like vapor transfer device, other shapes are envisioned, like, round, oblong, oval, shallow, deep, etc. Similarly, a plurality of vapor transfer methods is also envisioned, but more are available. For example, an absorbent pad may be used, without being situated within any type of box housing. The lone absorbent pad may be placed directly atop a textile surface. In that case, the solvent may be applied directly to the absorbent pad to maintain a minimum required level of vapor concentration on the surface of the textile.

In addition, variations in the removal or suction method are also envisioned. For example, the suction by wet vacuum process may be substituted by simply blotting the dissolved residue with an absorbent material. Depending on the type of textile in question, this blotting process may be preferred so as to avoid any liquid solvent contact with the textile's latex adhesive or binding material 21.

Additionally, it is envisioned that the vapor transfer box 10 be partitioned, to be used for large residue stains, or for small residue stains. Specifically, the absorbent pad 16 may comprise a plurality of smaller absorbent pads individually situated into individual compartments within the vapor transfer box 10. The individual compartments would give a technician greater control over where the solvent is dripped and poured, and consequently, the area that will be exposed to a greater amount of the solvent vapors. It is envisioned that the vapor transfer chamber 21 may also be partitioned to correspond with the partitions separating the absorbent pad 18.

Furthermore, although the specification and illustrated embodiments show the use of a solvent for softening the residue, it is envisioned that both non-volatile and volatile solvents may be used.

Finally, the general sequence of steps within the process may be performed in any order and/or combination to achieve the desired result. Also, the entire process may be repeated as many times as is necessary to achieve optimum residue removal.

Thus, while the present invention has been fully described above with particularity and detail in connection with what is presently deemed to be the most practical and preferred embodiment(s) of the invention, it will be apparent to those of ordinary skill in the art that numerous modifications, including, but not limited to, variations in size, materials, shape, form, function and manner of operation, assembly and use may be made, without departing from the principles and concepts of the invention as set forth in the claims.

What is claimed is:

1. A method for removing lacquer based residue from a textile surface, including the steps of:

providing a vapor transfer box;

providing an absorbent pad within the vapor transfer box;

placing the vapor transfer box above the textile surface having the lacquer based residue;

applying a liquid solvent to the absorbent pad and preventing the liquid solvent from passing through the absorbent pad and directly onto the textile surface, wherein solvent vapors from the liquid solvent diffuse from the absorbent pad and concentrate within the vapor transfer box over the lacquer based residue;

allowing the solvent vapors within the vapor transfer box to soften the lacquer based residue;

removing the transfer box from the textile surface after the residue has softened; and removing the lacquer based residue from the textile surface.

2. The method according to claim 1, wherein the step of removing the lacquer based residue further comprises the step of applying the liquid solvent directly to the softened residue and subsequently removing the softened residue and the liquid solvent simultaneously.

3. The method of claim 1, wherein the vapor transfer box comprises a solvent vapor chamber, and wherein solvent vapors from the solvent in the absorbent pad concentrate within the solvent vapor chamber.

4. The method according to claim 1, wherein the liquid solvent is selected from the group consisting of ethyl-acetate, N-methyl pyrrolidinone, acetone, dimethyl adipate, dimethyl glutarate, dimethyl succinate, 1-ethyl-2-pyrrolidinone, d-limonene, and methyl isobutyl carbinol.

5. The method of claim 1, wherein the vapor transfer box comprises a plurality of individual compartments, and wherein each individual compartment includes an absorbent pad.

6. The method of claim 1, after the step of applying a liquid solvent to the absorbent pad, further comprising; the step of positioning a lid on the vapor transfer box to concentrate the solvent vapors within the vapor transfer box.

7. The method of claim 1, wherein the lacquer based residue is fingernail polish.

8. The method of claim 1, wherein stabilizers, attached to a base of the vapor transfer box, firmly position the vapor transfer box over the textile surface and lacquer based residue.

9. The method of claim 2, wherein the liquid solvent is removed with a suction device.

10. The method of claim 3, after the step of applying a liquid solvent, further comprising, the step of evacuating ambient air in the solvent vapor chamber through at least one hole in the solvent vapor chamber.

11. The method of claim 3, wherein the absorbent pad comprises a plurality of smaller absorbent pads individually situated into partitioned compartments within the vapor transfer box.

12. The method of claim 2, wherein the liquid solvent is removed by blotting the softened residue with an absorbent material.

13. The method of claim 10, wherein the step of evacuating ambient air in the solvent vapor chamber through at least one hole in the solvent vapor chamber is accomplished by displacement of ambient air by said solvent vapors.

14. A method for softening lacquer based residue from a textile surface, including the steps of:

applying N-methyl pyrrolidinone liquid solvent to an absorbent material preventing said N-methyl pyrrolidinone liquid solvent from passing through the absorbent material and directly onto the textile surface;

placing the absorbent material over the textile surface having the lacquer based residue;

allowing N-methyl pyrrolidinone vapors from said liquid solvent to soften at least a portion of the lacquer based residue;

removing the absorbent material from the textile surface when the at least one portion of the lacquer based residue has sufficiently softened for removal; and removing the lacquer based residue from the textile surface.

15. The method according to claim 14, wherein the step of removing the lacquer based residue further comprises the step of applying the N-methyl pyrrolidinone liquid solvent directly to the softened residue and subsequently removing the softened residue and the solvent simultaneously.

16. The method of claim 14, wherein the absorbent material includes at least one solvent vapor chamber positioned over the lacquer based residue, and wherein N-methyl pyrrolidinone vapors concentrate within the solvent vapor chamber to contact and soften the lacquer based residue.

17. The method of claim 14, wherein the lacquer based residue is fingernail polish.

18. A method for softening lacquer based residue from a textile surface, including the steps of:

applying a liquid solvent selected from the group consisting of ethyl-acetate, N-methyl pyrrolidinone, acetone, dimethyl adipate, dirnethyl glutarate, dimethyl succinate, 1-ethyl-2-pyrrolidinone, d-limonene, and methyl isobutyl carbinol to an absorbent material preventing said liquid solvent from passing through the absorbent material and directly onto the textile surface;

placing the absorbent material over the textile surface having the lacquer based residue;

allowing solvent vapors from said liquid solvent to soften at least a portion of the lacquer based residue;

removing the absorbent material from the textile surface when the at least one portion of the lacquer based residue has sufficiently softened for removal; and removing the lacquer based residue from the textile surface.

* * * * *

UNITED STATES PATENT AND TRADEMARK OFFICE

CERTIFICATE OF CORRECTION

PATENT NO. : 6,905,553 B2 
DATED : June 14, 2005
INVENTOR(S) : Shawn T. Rodeback et al.

It is certified that error appears in the above-identified patent and that said Letters Patent is hereby corrected as shown below:

Column 5,
Line 37, should read -- removing the vapor transfer box from the textile surface after --.

Signed and Sealed this

Sixteenth Day of August, 2005

JON W. DUDAS
*Director of the United States Patent and Trademark Office*